US008091709B2

(12) United States Patent
Gnepper

(10) Patent No.: US 8,091,709 B2
(45) Date of Patent: Jan. 10, 2012

(54) CHILD-RESISTANT PACKAGE

(75) Inventor: Maurice R. Gnepper, Fremont, OH (US)

(73) Assignee: Rexam Healthcare Packaging Inc., Perrysburg, OH (US)

( * ) Notice: Subject to any disclaimer, the term of this patent is extended or adjusted under 35 U.S.C. 154(b) by 1223 days.

(21) Appl. No.: 11/450,768

(22) Filed: Jun. 9, 2006

(65) Prior Publication Data

US 2007/0284277 A1 Dec. 13, 2007

(51) Int. Cl.
*B65D 83/04* (2006.01)

(52) U.S. Cl. ..... 206/536; 206/425; 206/37; 206/557

(58) Field of Classification Search ..... 206/536, 206/425, 701, 722, 387.12, 528, 538, 1.5, 206/531, 540; 220/345.3, 345.2, 345.4, 351
See application file for complete search history.

(56) References Cited

U.S. PATENT DOCUMENTS

| | | | | | |
|---|---|---|---|---|---|
| 1,658,496 | A | | 2/1928 | Qvarnstrom | |
| 1,925,316 | A | * | 9/1933 | Fullmer | 132/287 |
| 3,782,584 | A | | 1/1974 | Swenson et al. | |
| 3,942,630 | A | | 3/1976 | Phillips | |
| 3,987,891 | A | | 10/1976 | Horvath | |
| 4,007,828 | A | | 2/1977 | Mayled | |
| 4,046,255 | A | * | 9/1977 | Ackeret | 206/387.12 |
| 4,126,224 | A | * | 11/1978 | Laauwe et al. | 206/540 |
| 4,561,544 | A | * | 12/1985 | Reeve | 206/540 |
| 4,817,819 | A | | 4/1989 | Kelly | |
| 4,844,284 | A | * | 7/1989 | Drozd et al. | 220/281 |
| 4,890,742 | A | | 1/1990 | Allison | |
| 5,080,222 | A | | 1/1992 | McNary | |
| 5,275,291 | A | * | 1/1994 | Sledge | 206/531 |
| 5,620,109 | A | | 4/1997 | Madden | |
| 6,341,693 | B2 | | 1/2002 | Konno et al. | |
| 6,976,576 | B2 | * | 12/2005 | Intini | 206/1.5 |
| 2005/0023183 | A1 | * | 2/2005 | Banik et al. | 206/581 |
| 2005/0194391 | A1 | * | 9/2005 | Domke et al. | 220/835 |
| 2007/0023317 | A1 | * | 2/2007 | Brozell et al. | 206/538 |

FOREIGN PATENT DOCUMENTS

| | | | |
|---|---|---|---|
| EP | 1117066 | A1 | 7/2001 |
| GB | 2042476 | A | 9/1980 |
| WO | WO 01/15998 | A1 | 3/2001 |

* cited by examiner

*Primary Examiner* — Mickey Yu
*Assistant Examiner* — Rafael Ortiz
(74) *Attorney, Agent, or Firm* — Reising Ethington PC

(57) ABSTRACT

A child-resistant package includes a rectangular tray having a pair of sidewalls, a pair of laterally opposed spring arms extending from the sidewalls, a finger tab on each spring arm and a locking lug adjacent to each finger tab. A rectangular shell has an open front end, a pair of sidewalls, a slot extending longitudinally along each of the sidewalls and terminating short of the open front end of the shell, and a locking pocket extending from each slot at a position spaced from the open end of the shell. The tray is slidably received in the shell with the spring arms interiorly adjacent to the shell sidewalls and the finger tabs slidably received in the slots. The locking lugs on the finger tabs are resiliently receivable in the locking pockets on the shell sidewalls in the closed position of the tray within the shell. The finger tabs may be pushed toward each other against resiliency of the spring arms to release the locking lugs from the locking pockets, and then slid forwardly along the slots until the finger tabs engage the ends of the slots adjacent to the open end of the shell to retain the tray within the shell in an open position of the tray extending from the open end of the shell. The tray preferably includes an integrally hinged lid that is closed when the tray is disposed within the shell.

12 Claims, 4 Drawing Sheets

CHILD-RESISTANT PACKAGE

The present disclosure relates to a compact-style child-resistant package for containing tablets or the like.

BACKGROUND AND SUMMARY OF THE DISCLOSURE

A general object of the present disclosure is to provide an economical compact-style child-resistant package for containing tablets or the like.

The present disclosure embodies a number of aspects that can be implemented separately from or in combination with each other.

A child-resistant package in accordance with one aspect of the present disclosure includes a rectangular tray having a pair of sidewalls, a pair of laterally opposed spring arms extending from the sidewalls, a finger tab on each spring arm and a locking lug adjacent to each finger tab. A rectangular shell has an open front end, a pair of sidewalls, a slot extending longitudinally along each of the sidewalls and terminating short of the open front end of the shell, and a locking pocket extending from each slot at a position spaced from the open end of the shell. The tray is slidably received in the shell with the spring arms interiorly adjacent to the shell sidewalls and the finger tabs slidably received in the slots. The locking lugs on the finger tabs are resiliently receivable in the locking pockets on the shell sidewall in the closed position of the tray within the shell. The finger tabs may be pushed toward each other against resiliency of the spring arms to release the locking lugs from the locking pockets, and then slid forwardly along the slots until the finger tabs engage the ends of the slots adjacent to the open end of the shell to retain the tray within the shell in an open position of the tray extending from the open end of the shell. The tray preferably includes an integrally hinged lid that is closed when the tray is disposed within the shell. The lid and the tray preferably include endless walls that seal the package in the closed position of the lid.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
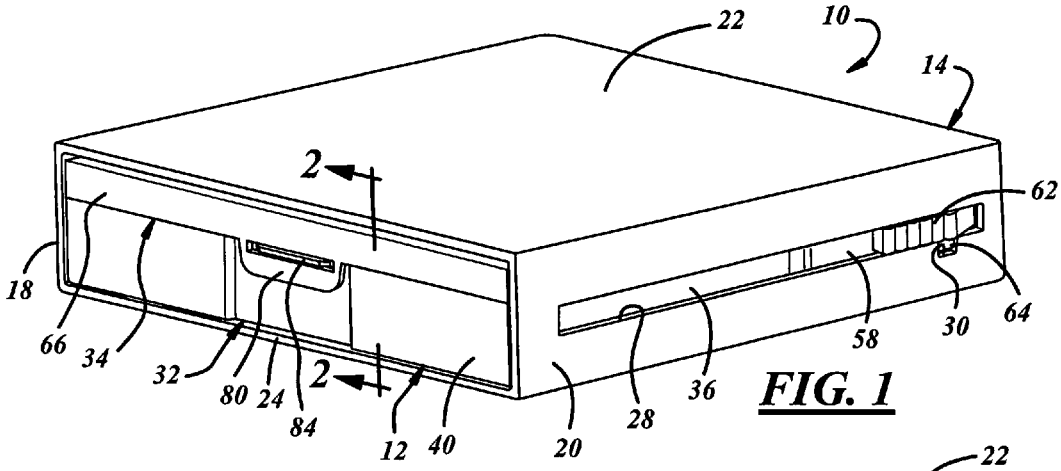
FIG. 1 is a perspective view of a compact-style child-resistant package in accordance with an exemplary embodiment of the present disclosure.
Figure 2:
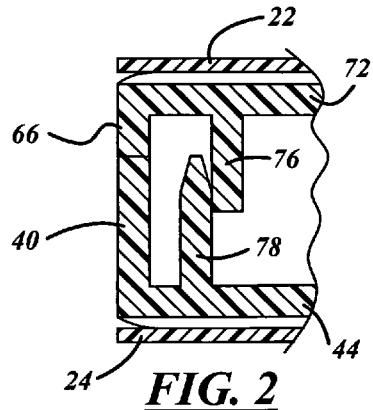
FIG. 2 is a fragmentary sectional view taken substantially along the line 2-2 in FIG. 1.
Figure 3:
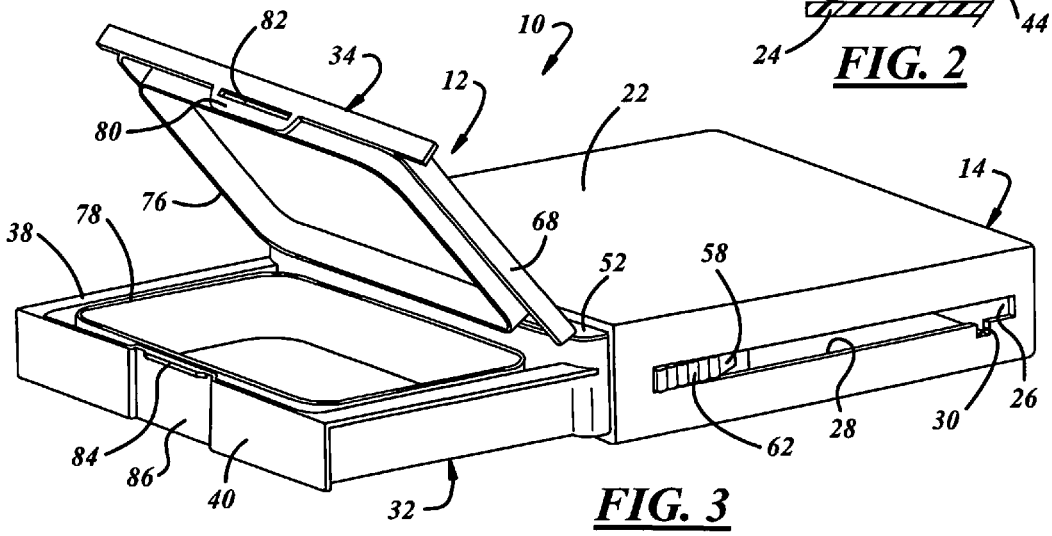
FIG. 3 is a perspective view of the package of FIG. 1 in an open condition.
Figure 9:
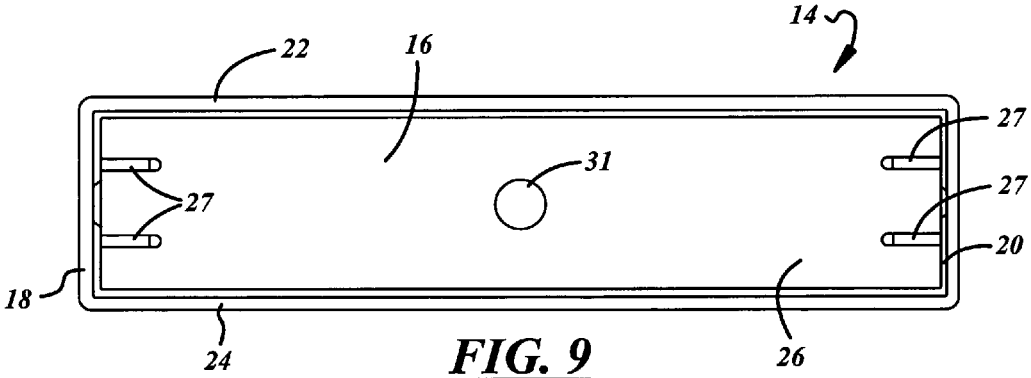
FIG. 9 is a front elevational view of the shell in FIG. 5.
Figure 10:
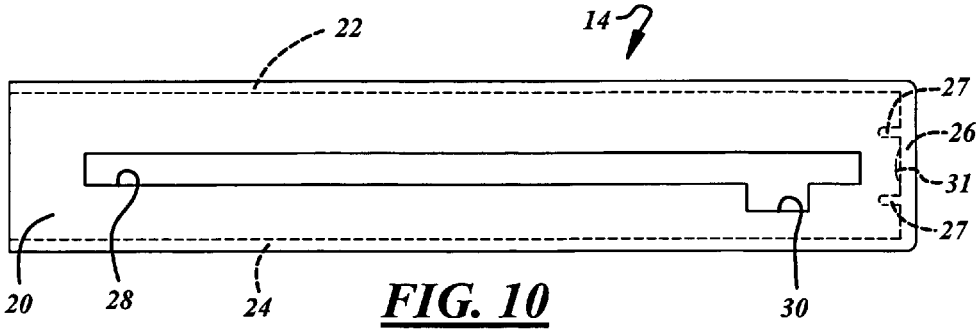
FIG. 10 is a side elevational view of the shell in FIGS. 5 and 9.

FIGS. 1-3 illustrate a child-resistant package 10 in accordance with an exemplary embodiment of the present disclosure. Package 10 preferably includes a two-piece assembly with a tray 12 slidably disposed within a shell 14. Shell 14 (FIGS. 1-3, 5 and 9-10) is of generally rectangular geometry including an open front 16 and a pair of laterally spaced parallel sidewalls 18,20. A top wall 22 and a bottom wall 24 are parallel to each other and interconnect sidewalls 18,20. The end of shell opposed to open front 16 preferably is closed by a back wall 26. Strengthening gussets 27 (FIGS. 9 and 10) preferably extend between back wall 26 and sidewalls 18,20 at each back corner of shell 14. A slot 28 extends longitudinally along each sidewall 18,20. Slots 28 terminate short of open front 16 at the front of the shell, and preferably terminate short of shell back wall 26. A locking pocket 30 extends laterally from each slot 28 at a position spaced from open end 16 of shell 14 and preferably adjacent to shell back wall 26. Shell 14 preferably is of one-piece molded plastic construction such as polypropylene, and the gate mark 31 (FIGS. 9 and 10) from injection molding shell 14 preferably is disposed in back wall 26.

Figure 4:
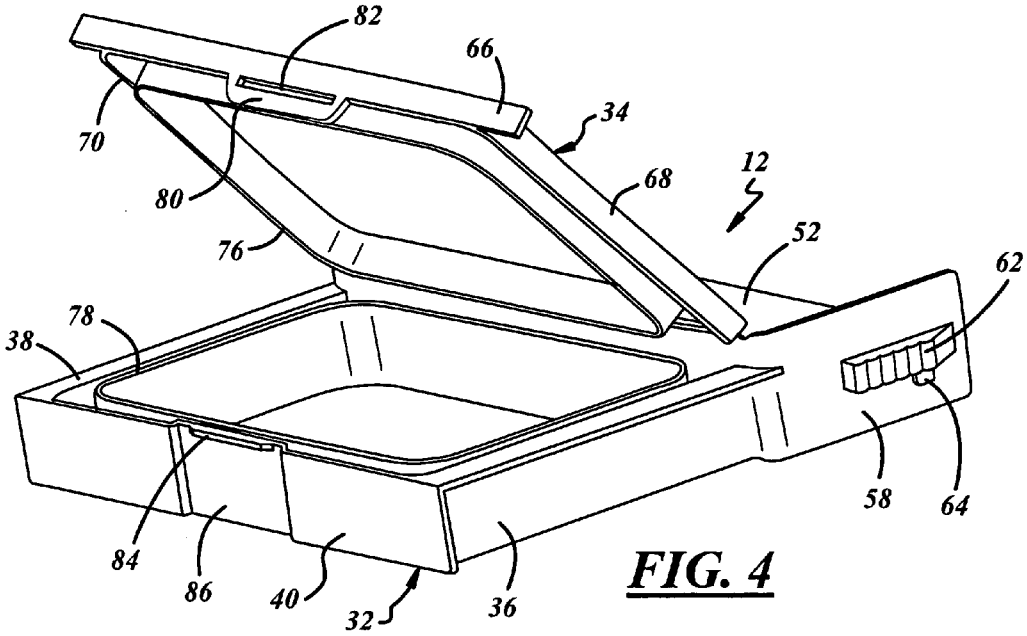
FIG. 4 is a perspective view of the tray in the package of FIGS. 1-3 with the lid open.
Figure 5:
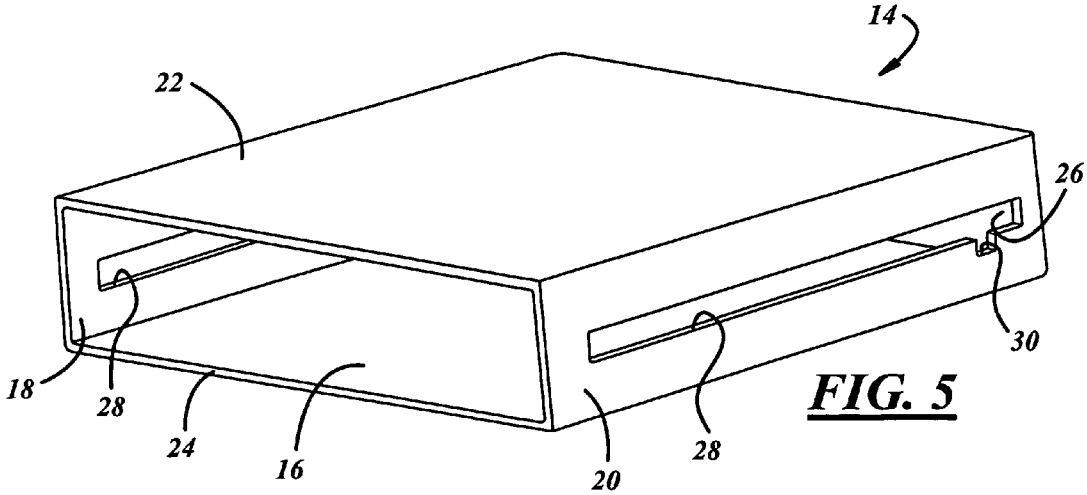
FIG. 5 is perspective view of the shell in the package of FIGS. 1-3.

Tray 12 (FIGS. 1-4 and 6-8), which also preferably is of one-piece molded plastic construction such as polypropylene, includes a base 32 and a lid 34. Base 32 is generally rectangular, having a pair of spaced parallel sidewalls 36, 38, a front wall 40, a back wall 42 and a bottom wall 44. Any injection molding gate mark 46 (FIGS. 6 and 7) preferably is disposed on bottom wall 44 within walls 36, 38, 40, 42. A ledge 48 extends rearwardly from back wall 42 parallel to bottom wall 44. Strengthening gussets 50 preferably extend between ledge 48 and back wall 42 for strengthening the ledge. An intermediate wall 52 is connected by a first linear hinge 54 to the edge of ledge 48 remote from back wall 42. Lid 34 is connected to intermediate wall 52 by a second linear hinge 56. Both linear hinges 54,56 are parallel to back wall 42. A pair of spring arms 58,60 are cantilevered from the laterally opposed ends of back wall 42 and extend away from sidewalls 36,38. Spring arms 58,60 preferably are generally rectangular in geometry, as best seen in FIG. 4, and each spring arm has an exteriorly disposed finger tab 62. Finger tabs 62 preferably have ribbed or serrated outer surfaces to facilitate gripping to open the package, as will be described. Finger tabs 62 are dimensioned to slide freely within shell slots 28. A locking lug 64 extends from each finger tab 62, preferably extending from the lower surface of each finger tab along the adjacent outer surface of spring arms 58, 60.

Figure 6:
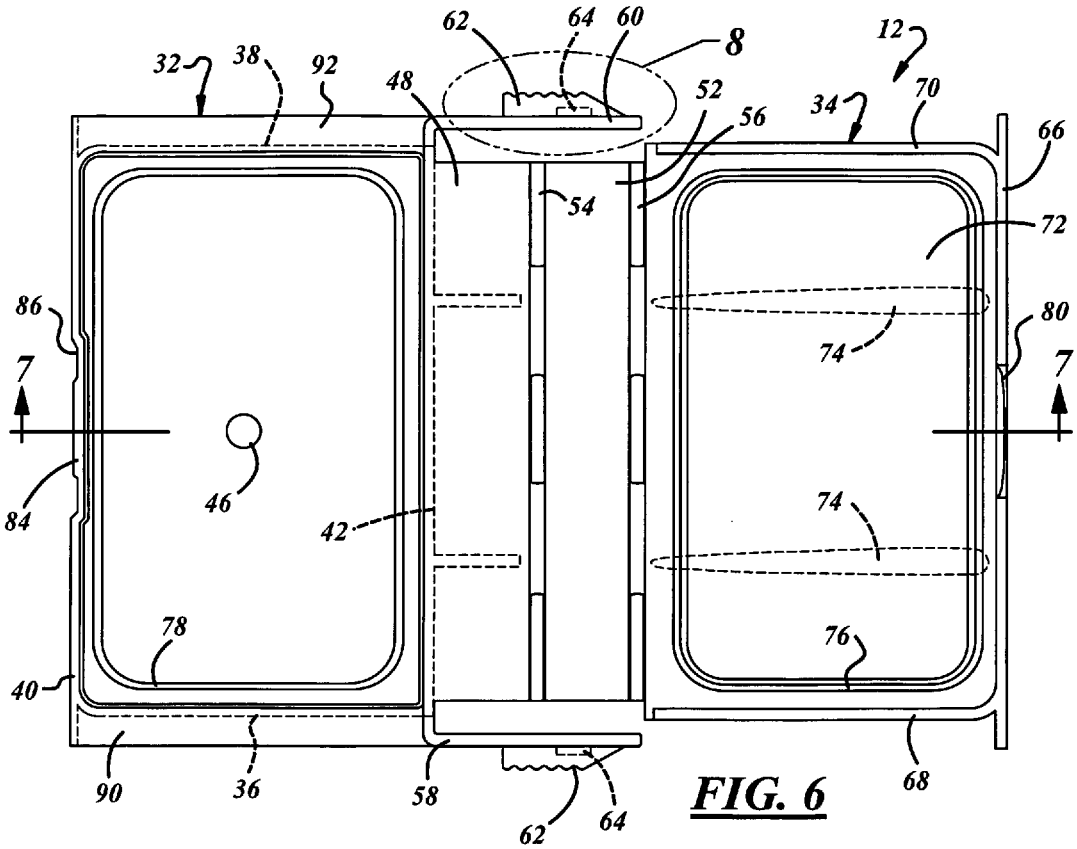
FIG. 6 is a top plan view of the tray of FIG. 4 as molded.
Figure 7:
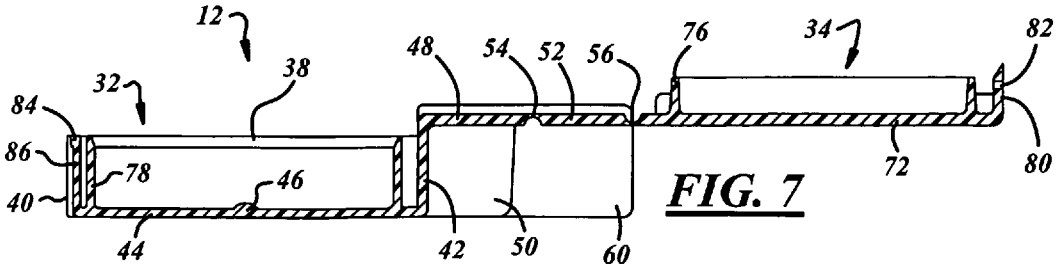
FIG. 7 is a sectional view taken substantially along the line 7-7 in FIG. 6.
Figure 8:
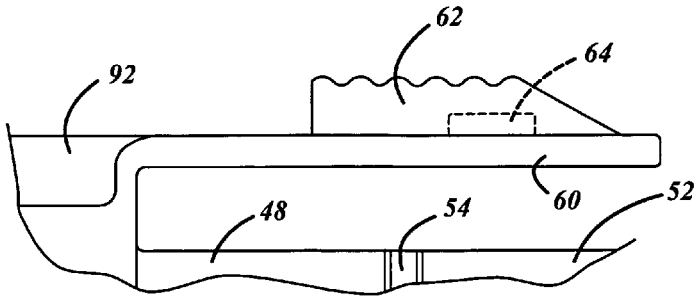
FIG. 8 is a fragmentary view on an enlarged scale of the portion of FIG. 6 within the area 8.

Front wall 40 and back wall 42 extend laterally beyond sidewalls 36, 38. A shelf 90, 92 extends from front wall 40 to back wall 42 along the upper edges of respective sidewalls 36, 38 to rigidify the base. As best seen in FIG. 7, which illustrates tray 12 as molded in the exemplary embodiment of the disclosure, ledge 48 and intermediate wall 52 are elevated from the upper edges of sidewalls 36, 38 and front wall 40. Lid 34 has a front wall 66 and a pair of sidewalls 68, 70 that are parallel to each other and substantially perpendicular to front wall 66. Sidewalls 68,70 and front wall 66 extend along three edges of a lid base wall 72. The edge of lid base wall 72 remote from front wall 66 is connected to intermediate wall 52 by linear hinge 56, which also preferably is parallel to front wall 66. Ribs 74 (FIG. 6) may be provided on the outer surface of lid base wall 72 to strengthen the lid. Front wall 66 extends laterally outwardly from sidewalls 68,70 so as to overlie front wall 40 of base 32 in the closed position (FIG. 1). In this closed position, lid sidewalls 68, 70 engage sidewalls 36, 38 of base 32. Lid 34 also preferably has an endless wall 76 disposed within sidewalls 68, 70 and front wall 66 for receipt (FIG. 2) within an endless wall 78 on base 32. Walls 76, 78 preferably are rectangular and dimensioned such that wall 76 is received by interference fit within wall 78 both to seal the package and to retain lid 34 in the closed position with respect to base 32 when tray 12 initially is extended from the shell. Wall 78 also forms a compartment for product, such as tablets, placed within the package. Front wall 66 of lid 34 also has an ear 80 with a lateral slot 82 for receipt over a rib 84 within an indentation 86 in front wall 40 of base 32 in the closed position of the lid (FIG. 1). FIG. 6 illustrates base 32 and lid 34 as molded. Lid 34 is initially closed over base 32 by folding along first hinge 54 so that intermediate wall 52 overlies ledge 48. Lid 34 can then be opened and closed with respect to base 32 by pivoting lid 34 around second hinge 56.

In the closed position of tray 12 within shell 14 illustrated in FIGS. 1 and 2, lid 34 is sealed against base 32 and locking lugs 64 are received within pockets 30 to hold the tray in position. Ear 80 on lid 34 is received over rib 84 on base 32. Spring arms 58, 60 may be angulated outwardly from each other as molded so that the spring arms are resiliently urged against the inside surfaces of shell sidewalls 18,20 in assembly. To open the package, finger tabs 62 are engaged by the thumb and an opposed finger of a user and squeezed laterally toward each other against the resiliency of the spring arms. This inward motion of the spring arms moves locking lugs 64 out of engagement with locking pockets 30, so that the tray may now be slid out of open end 16 of shell 14 by pushing finger tabs 62 along slots 28. The front ends of slots 28 cooperate with finger tabs 62 to prevent removal of tray 12 from shell 14 in the fully extended position of FIG. 3 unless additional force is applied to the finger tabs. In the fully extended position of FIG. 3, lid 34 of tray 12 may be opened with respect to base 32 by placing a thumb or finger in recess 86 and unlatching ear 80 from rib 84 to provide access to the tablets or other product within the tray. To close the package, lid 34 is closed against base 32 and tray 12 is pushed into shell 14 until locking lugs 64 are received by resilient snap-fit within pockets 30 of shell 14. Tray 12 also can be simply pushed into shell 14 so that the front edge of shell top wall 22 automatically closes lid 34. In the exemplary embodiment of the disclosure, top wall 22, back wall 26 and bottom wall 24 of shell 14 form three contiguous surfaces to which one or more labels can be applied. As initially packaged, a label also could extend over front wall 40 of tray 12 and be removable along perforations, for example, to provide indication that the package has been opened.

There thus has been disclosed a child-resistant package that fully satisfies all of the objects and aims previously set forth. The package has been disclosed in conjunction with a presently preferred but exemplary embodiment, and a number of modifications and variations have been described. Other modifications and variations readily will suggest themselves to persons of ordinary skill in the art in view of the foregoing description. The disclosure is intended to embrace all such modifications and variations as fall within the spirit and broad scope of the appended claims.

The invention claimed is:

1. A child-resistant package that includes:

a rectangular tray having a base including an endless wall, a pair of sidewalls, a back wall extending between said sidewalls, a pair of laterally opposed spring arms extending from opposed ends of said back wall away from said sidewalls, a finger tab on each said spring arm, a locking lug adjacent to each said finger tab and a lid integrally hinged to said back wall, wherein said lid is openable with respect to said base when said tray is in a fully extended position and said lid closes with respect to said base when said tray is pushed into said shell, and a rectangular shell having an open front end, a closed back end, a pair of sidewalls, a slot extending longitudinally along each of said sidewalls and terminating short of said open front end of said shell, and a locking pocket extending from each said slot at a position spaced from said open front end, said tray being slidably received in said shell with said spring arms interiorly adjacent to said shell sidewalls and said finger tabs slidably received in said slots, said locking lugs being receivable in said locking pockets in a closed position of said tray within said shell with said lid being closed against said sidewalls of said tray, said lid having an endless seal wall interference fit with said endless wall on said tray to seal said package when said lid is closed, said spring arms being resiliently movable, wherein the package is opened by squeezing said finger tabs toward each other to release said locking lugs from said locking pockets and permit sliding of said tray out of said shell and by pushing said finger tabs along said slots until said finger tabs engage ends of said slots adjacent to said open front end of said shell to retain said tray within said shell in an open position of said tray extending from said open front end of said shell.

2. The package set forth in claim 1 wherein said endless wall on said tray is spaced from said sidewalls and said back wall of said tray.

3. The package set forth in claim 2 wherein said tray has a front wall that projects laterally outwardly from said sidewalls.

4. The package set forth in claim 3 wherein said shell has a top wall, said closed back end and a bottom wall that form three contiguous surfaces for label application.

5. The package set forth in claim 1, wherein said slots terminate at said open front end of said shell and terminate short of said closed back end of said shell, said locking pockets extend laterally from said slots adjacent to said closed back end of said shell, and the package is closed by pushing said tray into said shell until said locking lugs are received by resilient snap-fit within said locking pockets.

6. A child-resistant package that includes:

a rectangular tray having a pair of sidewalls, a back wall extending between said sidewalls, a pair of laterally opposed spring arms extending from opposed ends of said back wall away from said sidewalls, a finger tab on each said spring arm, a locking lug adjacent to each said finger tab and a lid integrally hinged to said back wall, and a rectangular shell having an open front end, a closed back end, a pair of sidewalls, a slot extending longitudinally along each of said sidewalls and terminating short of said open front end of said shell, and a locking pocket extending from each said slot at a position spaced from said open front end, said tray being slidably received in said shell with said spring arms interiorly adjacent to said shell sidewalls and said finger tabs slidably received in said slots, said locking lugs being receivable in said locking pockets in a closed position of said tray within said shell with said lid being closed against said sidewalls of said tray, said lid having an endless seal wall interference fit with an endless wall on said tray to seal said package when said lid is closed, said spring arms being resiliently movable, wherein the package is opened by squeezing said finger tabs toward each other to release said locking lugs from said locking pockets and permit sliding of said tray out of said shell and by pushing said finger tabs along said slots until said finger tabs engage ends of said slots adjacent to said open front end of said shell to retain said tray within said shell in an open position of said tray extending from said open front end of said shell, wherein said tray includes a base that includes a ledge extending from said back wall of said tray and at least one hinge connecting said lid to said ledge, and wherein said at least one hinge includes a first linear hinge parallel to said back wall and an intermediate wall foldable by said first linear hinge over said ledge.

7. The package set forth in claim 6 wherein said at least one hinge also includes a second linear hinge connecting said lid to said intermediate wall such that said lid is foldable over said base by said second hinge.

8. The package set forth in claim 7 including gussets connecting said ledge to said back wall of said base.

9. The package set forth in claim 8 including second gussets connecting said sidewalls to said back wall of said base.

10. The package set forth in claim 6, wherein said slots terminate at said open front end of said shell and terminate short of said closed back end of said shell, said locking pockets extend laterally from said slots adjacent to said closed back end of said shell, and the package is closed by pushing said tray into said shell until said locking lugs are received by resilient snap-fit within said locking pockets.

11. A child-resistant package that includes:

a rectangular tray having a pair of sidewalls, a pair of laterally opposed spring arms extending from said sidewalls, a finger tab on each said spring arm and a locking lug adjacent to each said finger tab, and a rectangular shell having an open front end, a pair of sidewalls, a slot extending longitudinally along each of said sidewalls and terminating short of said open front end of said shell, and a locking pocket extending from each said slot at a position spaced from said open front end, said tray being slidably received in said shell with said spring arms interiorly adjacent to said sidewalls of said shell and said finger tabs being slidably received in said slots, said locking lugs being receivable in said locking pockets in a closed position of said tray enclosed by said shell, said spring arms being resiliently movable, toward each other to release said locking lugs from said locking pockets and permit sliding of said tray out of said shell by pushing said finger tabs along said slots until said finger tabs engage ends of said slots adjacent to said open front end of said shell to retain said tray in said shell in an open position of said tray extending from said open front end of said shell, wherein said tray has a back wall extending between and projecting laterally outwardly from said sidewalls, and wherein said spring arms extend from opposed ends of said back wall away from said sidewalls of said tray.

12. The package set forth in claim 11 wherein said base has a front wall that projects laterally outwardly from said sidewalls.

* * * * *